US009248962B2

(12) United States Patent
Warren

(10) Patent No.: US 9,248,962 B2
(45) Date of Patent: Feb. 2, 2016

(54) INFLATABLE REFUSE CONTAINERS AND METHODS OF USE

(71) Applicant: William J. Warren, Frisco, TX (US)

(72) Inventor: William J. Warren, Frisco, TX (US)

( * ) Notice: Subject to any disclaimer, the term of this patent is extended or adjusted under 35 U.S.C. 154(b) by 0 days.

(21) Appl. No.: 14/287,133

(22) Filed: May 26, 2014

(65) Prior Publication Data

US 2015/0023613 A1 Jan. 22, 2015

Related U.S. Application Data

(60) Provisional application No. 61/855,947, filed on May 28, 2013.

(51) Int. Cl.
*B65D 30/00* (2006.01)
*B65F 1/02* (2006.01)
*B65D 81/05* (2006.01)

(52) U.S. Cl.
CPC ..... *B65F 1/02* (2013.01); *B65D 81/052* (2013.01); *B65F 2220/116* (2013.01); *B65F 2230/00* (2013.01)

(58) Field of Classification Search
CPC ..... B65D 81/052; A45C 7/0081
USPC ..... 383/3; 206/522
See application file for complete search history.

(56) References Cited

U.S. PATENT DOCUMENTS 3,000,185 A 9/1961 Brinkmann et al.
3,039,120 A 6/1962 Powell et al.
3,044,515 A 7/1962 Eades
3,109,184 A 11/1963 Moore, Jr.
3,186,543 A 6/1965 Minick et al.
3,204,866 A 9/1965 Brighton et al.
3,241,560 A 3/1966 Willat
3,294,223 A * 12/1966 Goban ..... B65D 81/056 206/522
3,556,186 A * 1/1971 Besthorne et al. ..... 383/3
3,742,994 A * 7/1973 Pensak ..... 383/3
3,786,526 A 1/1974 Ausseil
3,913,907 A 10/1975 Baker
4,375,809 A * 3/1983 Meals ..... A61F 5/3753 128/845
4,384,603 A 5/1983 Tyrer et al.
4,612,781 A * 9/1986 Swerdon ..... 62/457.1
4,809,444 A 3/1989 Henderson et al.
4,858,755 A * 8/1989 Kuivanen ..... 119/269
4,867,576 A * 9/1989 Boyd ..... 383/33
4,919,290 A 4/1990 Wadel
4,941,754 A * 7/1990 Murdock ..... 383/3
5,011,137 A 4/1991 Murphy (Continued)

FOREIGN PATENT DOCUMENTS

EP 374360 6/1990
GB 2314004 12/1997
WO WO 9501294 1/1995

OTHER PUBLICATIONS

Translation of EP 374360 (Achterberg et al.), Jun. 27, 1990, pp. 3 and 8.

*Primary Examiner* — Jes F Pascua
(74) *Attorney, Agent, or Firm* — Carr & Ferrell LLP

(57) ABSTRACT

A trash container for holding trash may include a flexible first sidewall, a flexible second sidewall opposed and in a spaced relationship to the first sidewall to define a cavity, a bottom rigid wall connected to the flexible first sidewall and the flexible second sidewall to seal the cavity, and a top ring connected to the flexible first sidewall and the flexible second sidewall to seal the cavity.

4 Claims, 8 Drawing Sheets

(56) References Cited

U.S. PATENT DOCUMENTS

| | | | | | |
|---|---|---|---|---|---|
| 5,102,120 | A | | 4/1992 | Lindblad | |
| 5,127,523 | A | | 7/1992 | Herdlicka | |
| 5,209,364 | A | | 5/1993 | LaPoint, Jr. | |
| 5,314,250 | A | * | 5/1994 | Lee | 383/3 |
| 5,692,833 | A | * | 12/1997 | DeLuca | 383/3 |
| 5,735,495 | A | | 4/1998 | Kubota | |
| 6,123,217 | A | * | 9/2000 | Miller | 220/592.19 |
| 6,540,647 | B2 | | 4/2003 | Spooner et al. | |
| 6,606,880 | B1 | * | 8/2003 | Carlin et al. | 62/457.2 |
| 6,899,581 | B1 | | 5/2005 | Nokes | |
| 8,771,150 | B2 | | 7/2014 | Warren | |
| 2005/0066562 | A1 | | 3/2005 | Bober et al. | |
| 2013/0172158 | A1 | | 7/2013 | Warren | |
| 2013/0225061 | A1 | | 8/2013 | Warren | |
| 2013/0225062 | A1 | | 8/2013 | Warren | |
| 2013/0316883 | A1 | | 11/2013 | Warren | |
| 2015/0021333 | A1 | | 1/2015 | Warren | |
| 2015/0076145 | A1 | | 3/2015 | Warren | |

* cited by examiner

INFLATABLE REFUSE CONTAINERS AND METHODS OF USE

PRIORITY

The present application claims priority under 35 USC Section 119 based upon U.S. Provisional Application No. 61/855,947, which was filed on May 28, 2013.

FIELD OF THE INVENTION

The present invention relates to trash containers and more particularly to a trash container having flexible walls.

BACKGROUND

Trash is a common problem around the home, office and outdoors. In order to collect this trash, trash cans have been used. However, these trash cans can be small and generally have rigid sidewalls. The rigid sidewalls prevent the trash cans from being flattened out and stored in a relatively small space. What is needed is a trash can which can be easily deployed and easily stored in a limited space.

SUMMARY

A trash container for collecting trash may include an outer container having a first cavity and an inner container being detachably connected to the outer container and being positioned within the first cavity. The outer container may include a bottom first wall, opposing first side walls and a back first wall to define the first cavity. The inner container may include a bottom inner wall, the opposing inner sidewalls, and a back inner wall to define a second cavity.

The container may have an inflatable frame in between outer and inner walls. The container may have a bottom floor fused into a singular floor, supporting the frame.

The container may be inflatable by an inflation tube.

The bottom wall may be rectangular.

The top ring may be circular.

The top ring may be oval or any other geometric shape.

The trash container may include a release valve.

The trash container may include a cleat.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
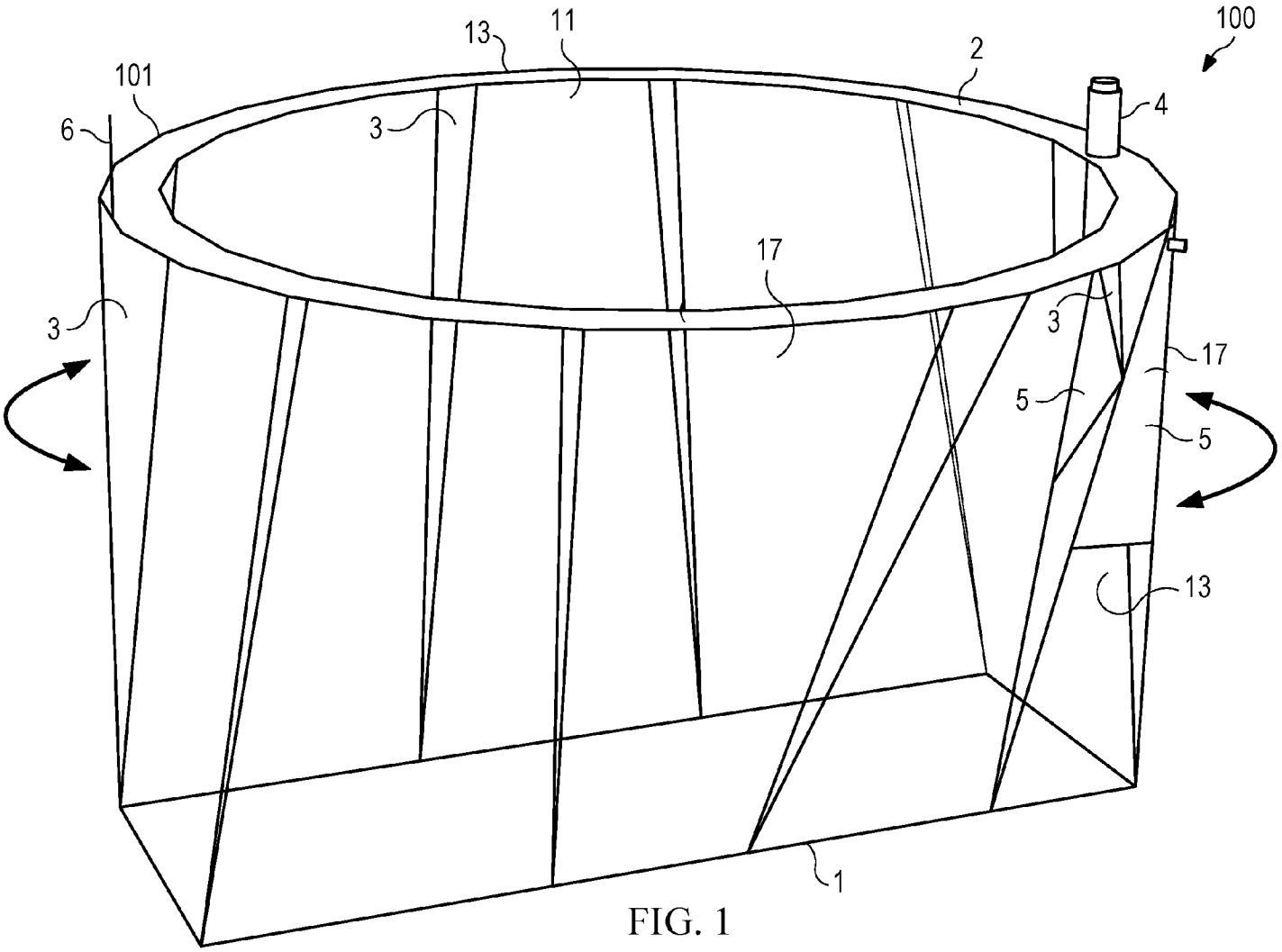
FIG. 1 illustrates a perspective view of an exemplary trash container of the present invention.

FIG. 1 illustrates a perspective view of an exemplary trash container 100 of the present invention, including a flexible frame 101, which may include a bottom wall 1 that may be connected to an inner sidewall 11 and may further be connected to an outer sidewall 13. The inner sidewall 11 and the outer sidewall 13 may completely extend around the periphery of the bottom wall 1, and the inner wall 11 and the outer wall 13 may be positioned in a spaced relationship to define a cavity 3. The cavity 3 may be filled with fluid, which may be a liquid, such as water, or a gas, such as air, in order to maintain the spaced relationship between the inner wall 11 and the outer wall 13 such that the inner wall 11 and the outer wall 13 extend upwards from the bottom wall 1. The bottom wall 1 may be shaped as a rectangle, oval, square, circle, or any other appropriate shape.

The inner sidewall 11 and the outer sidewall 13 may be flexible. The inner sidewall 11 and the outer sidewall 13 may connect and may also completely extend to and around a top peripheral wall, which may be a top peripheral ring 2. The top peripheral ring 2 may form a seal with the inner sidewall 11 and the outer sidewall 13. The peripheral ring 2 may further have one or more tie straps 6. Furthermore, the bottom wall 1 may form a seal with the inner sidewall 11 and the outer sidewall 13. The peripheral ring 2 may be a circle, oval, or any other appropriate shape. The peripheral ring 2 may be flexible and may define an opening 15 into a holding cavity 17 for users to place trash and be held until pick up. The peripheral ring 2 may have one or more tie straps 6.

FIG. 1 additionally illustrates an inflation tube 4 to inflate the cavity 3 and may include a valve or may include a sealing cap to seal the inflation tube 4. The material of the bottom wall 1, the top ring 2, the inner sidewall 11 and the outer sidewall 13 may be formed from flexible or rigid material or may be formed from thin plastic sheets 5 such as HEFTY, GLAD, or a similar type of material. The bottom wall 1 may be rigid and may be solid.

Figure 1A:
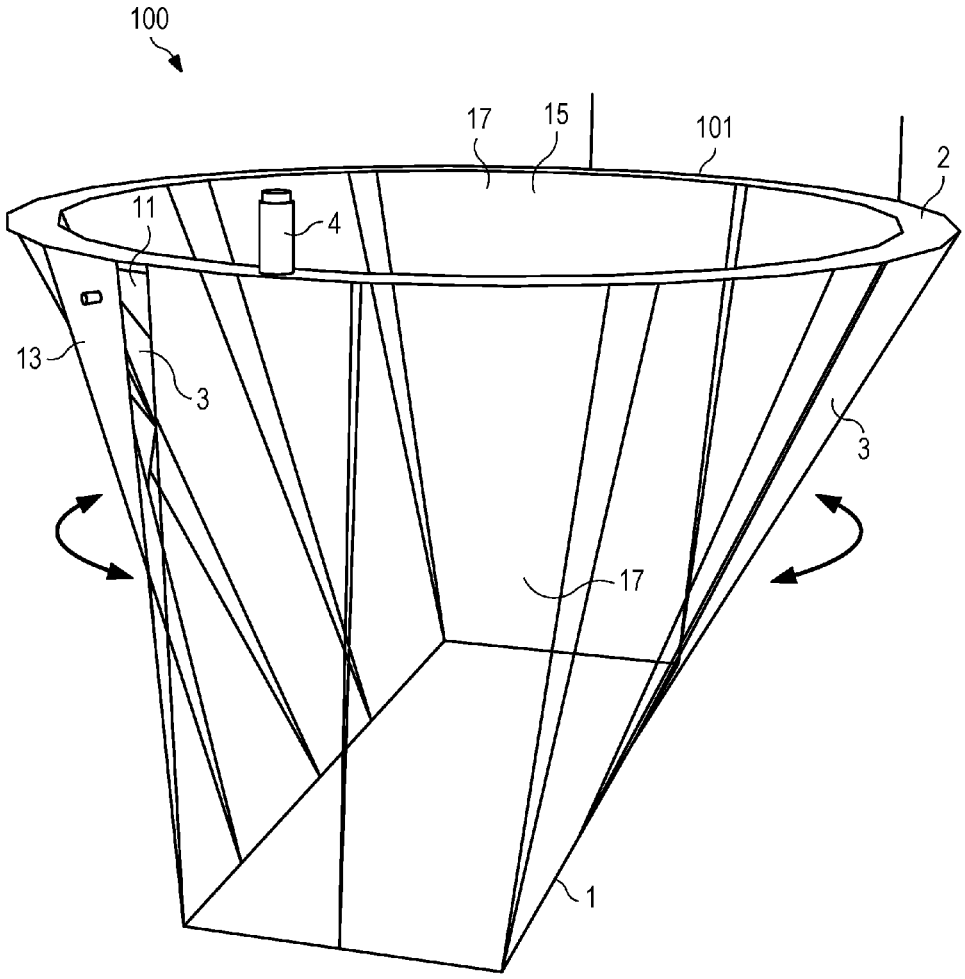
FIG. 1A illustrates another perspective view of the exemplary trash container of the present invention.

FIG. 1A illustrates a perspective view of the exemlary trash container 100 of the present invention, which may include a bottom wall 1 that may be connected to an inner sidewall 11 and may further be connected to an outer sidewall 13. The inner sidewall 11 and the outer sidewall 13 may be flexible and may completely extend around the periphery of the bottom wall 1, and the inner wall 11 and the outer wall 13 may be positioned in a spaced relationship to define a cavity 3. The cavity 3 may be filled with fluid that may be a liquid, such as water, or a gas, such as air, in order to maintain the spaced relationship between the inner wall 11 and the outer wall 13 such that the inner wall 11 and the outer wall 13 extend upwards from the bottom wall 1. The bottom wall 1 may be shaped as a rectangle, oval, square, circle, or any other appropriate shape.

The inner sidewall 11 and the outer sidewall 13 may connect and may also completely extend to and around a top peripheral wall, which may be flexible and may be a top peripheral ring 2. The top peripheral ring 2 may form a seal with the inner sidewall 11 and the outer sidewall 13. Furthermore, the bottom wall 1 may form a seal with the inner sidewall 11 and the outer sidewall 13. The peripheral ring 2 may be a circle, oval, or any other appropriate shape. The peripheral ring 2 may define an opening 15 into a holding cavity 17 for users to place trash and be held until pick up.

FIG. 1A additionally illustrates an inflation tube 4 to inflate the cavity 3 and may include a valve or may include a sealing cap to seal the inflation tube 4. The material of the bottom wall 1, the top ring 2, the inner sidewall 11, and the outer sidewall 13 may be formed from flexible or rigid material or may be formed from thin plastic sheets such as HEFTY, GLAD, or a similar type of material. The bottom wall 1 may be rigid and may be solid.

Figure 3:
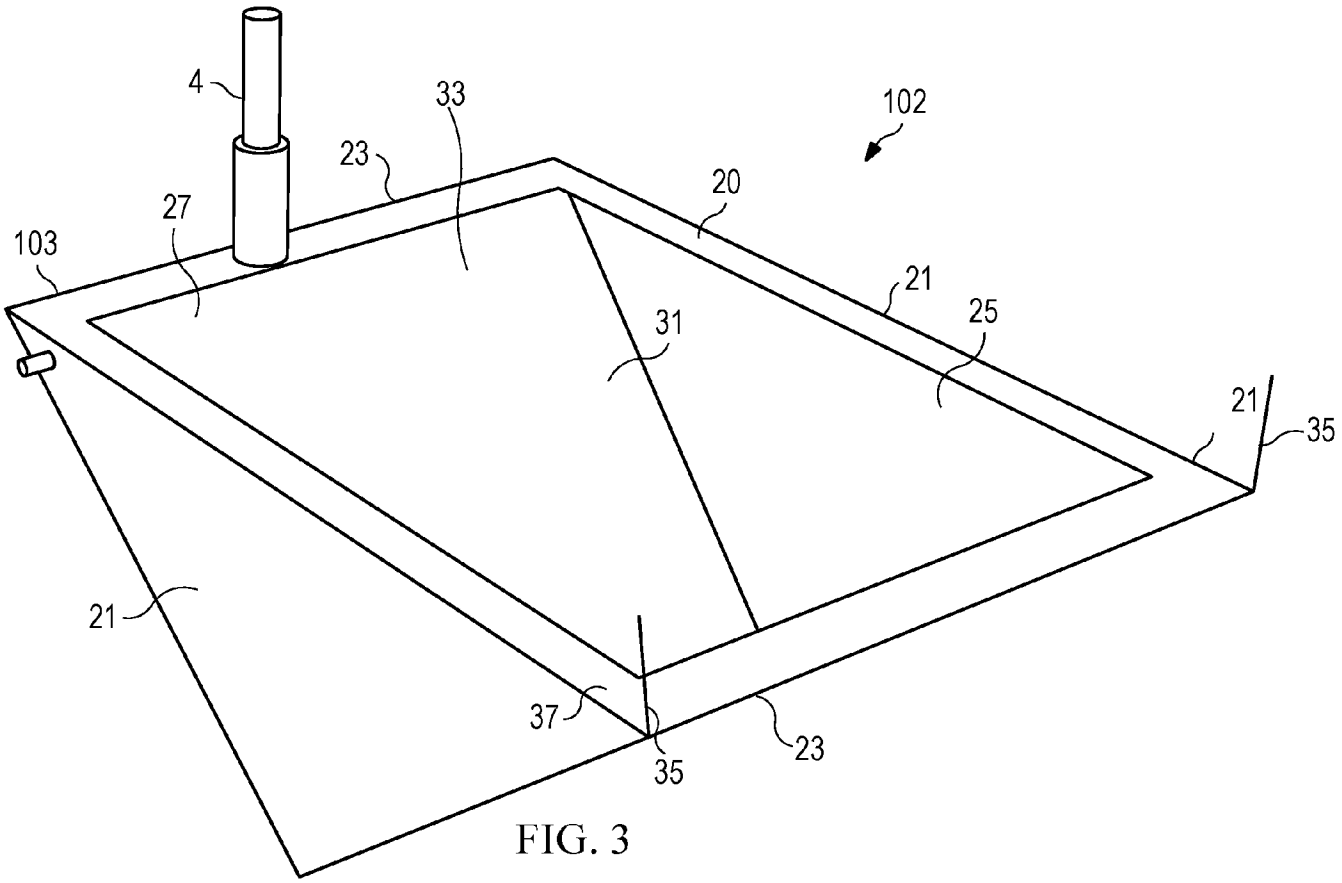
FIG. 3 illustrates another embodiment of the exemplary trash container of the present invention.

FIG. 3 illustrates another exemplary trash container 102 of the present invention, including a flexible frame 103. The trash container may include a pair of opposing first outer mirror sidewalls 21 that may be substantially triangular in shape and may be connected to a pair of opposing second outer mirror sidewalls 23. The second outer mirror sidewalls 23 may be connected to form a continuous periphery with the first outer mirror sidewalls 21, which may be flexible. The second outer mirror sidewalls 23 may be flexible and may be substantially rectangular in shape.

The trash container 102 may include a pair of opposing first inner mirror sidewalls 25 which may be flexible that may be substantially triangular in shape and may be in a spaced relationship with the first outer mirror sidewalls 21, defining a cavity 37 between the first inner mirror sidewalls 25 and the first outer mirror sidewalls 21. The first inner mirror sidewalls 25 may be flexible and may further be connected to a pair of opposing second inner mirror sidewalls 27. The second inner mirror sidewalls 27 may be flexible and in a spaced relationship with the second outer mirror sidewalls 23, defining a cavity 37 between the second inner mirror sidewalls 27 and the second outer mirror sidewalls 23. The first inner mirror sidewalls 25 and the second inner mirror sidewalls 27 may be connected around a continuous periphery of the first inner mirror sidewalls 25 and the second inner mirror sidewalls 27.

FIG. 3 additionally illustrates an inflation tube 4 to inflate the exemplary trash container 102. The cavity 37 may be filled with fluid including a gas or liquid, such as air or water.

The trash container 102 additionally includes a top peripheral wall 20 that may be flexible and may extend around and seal the first outer mirror sidewalls 21, the second outer mirror sidewalls 23, the first inner mirror sidewalls 25, and the second inner mirror sidewalls 27. The first and second inner mirror sidewalls 25, 27 define a holding cavity 31 where trash may be stowed. The holding cavity 31 may include an opening 33 to allow the trash to enter the holding cavity 31.

The top peripheral wall 20 may be connected to tie straps 35.

Figure 2:
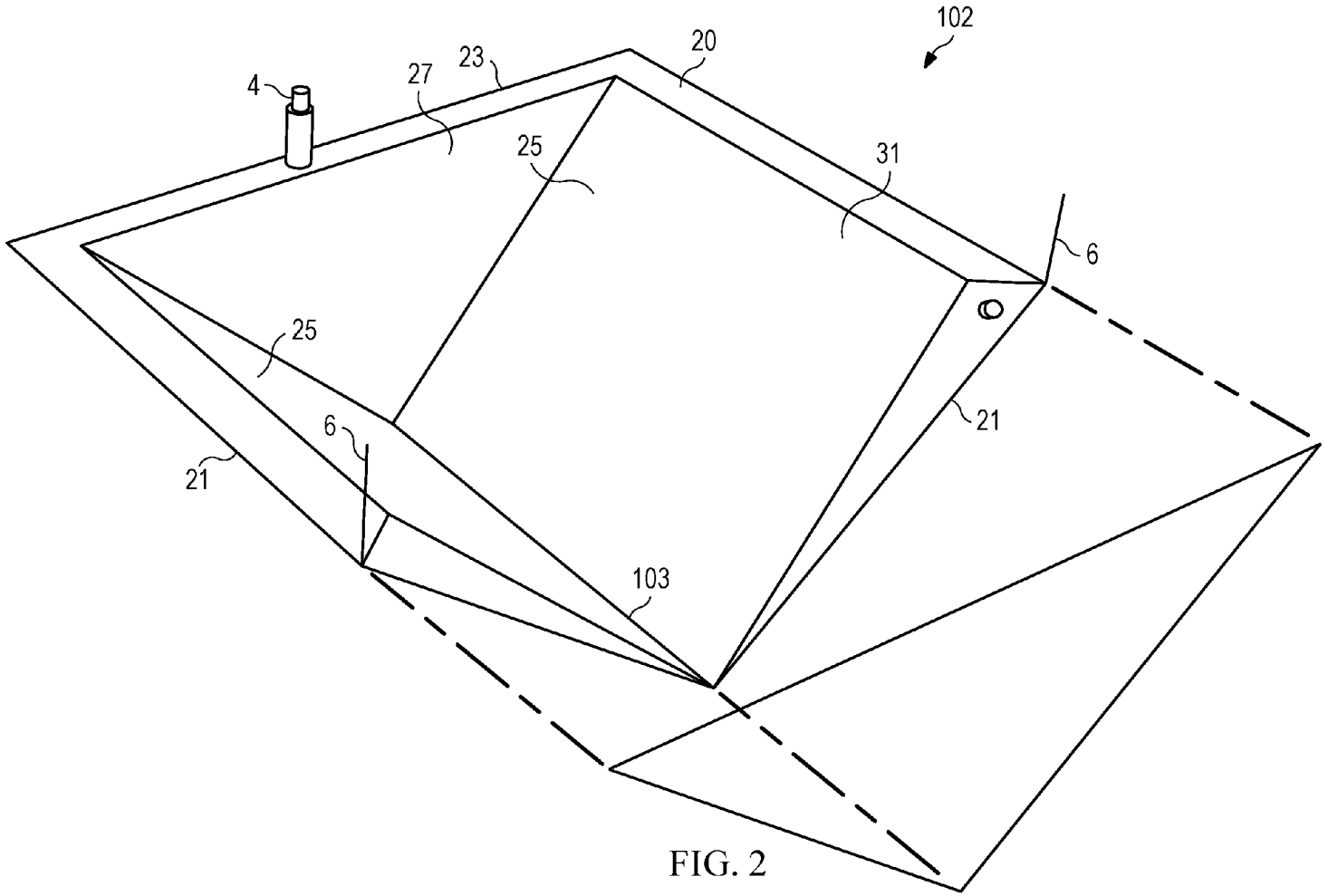
FIG. 2 illustrates a perspective view of an exemplary trash container of the present invention.

FIG. 2 illustrates an exemplary trash container 102 having the top peripheral wall 20, the first outer mirror sidewalls 21, the second outer mirror sidewalls 23, the first inner mirror sidewalls 25, and the second inner mirror sidewalls 27 (all flexible) only extending around two sides of the trash container 102 to provide enhanced access to the holding cavity 31. The top peripheral wall 20 may have one or more tie straps 6.

Figure 4:
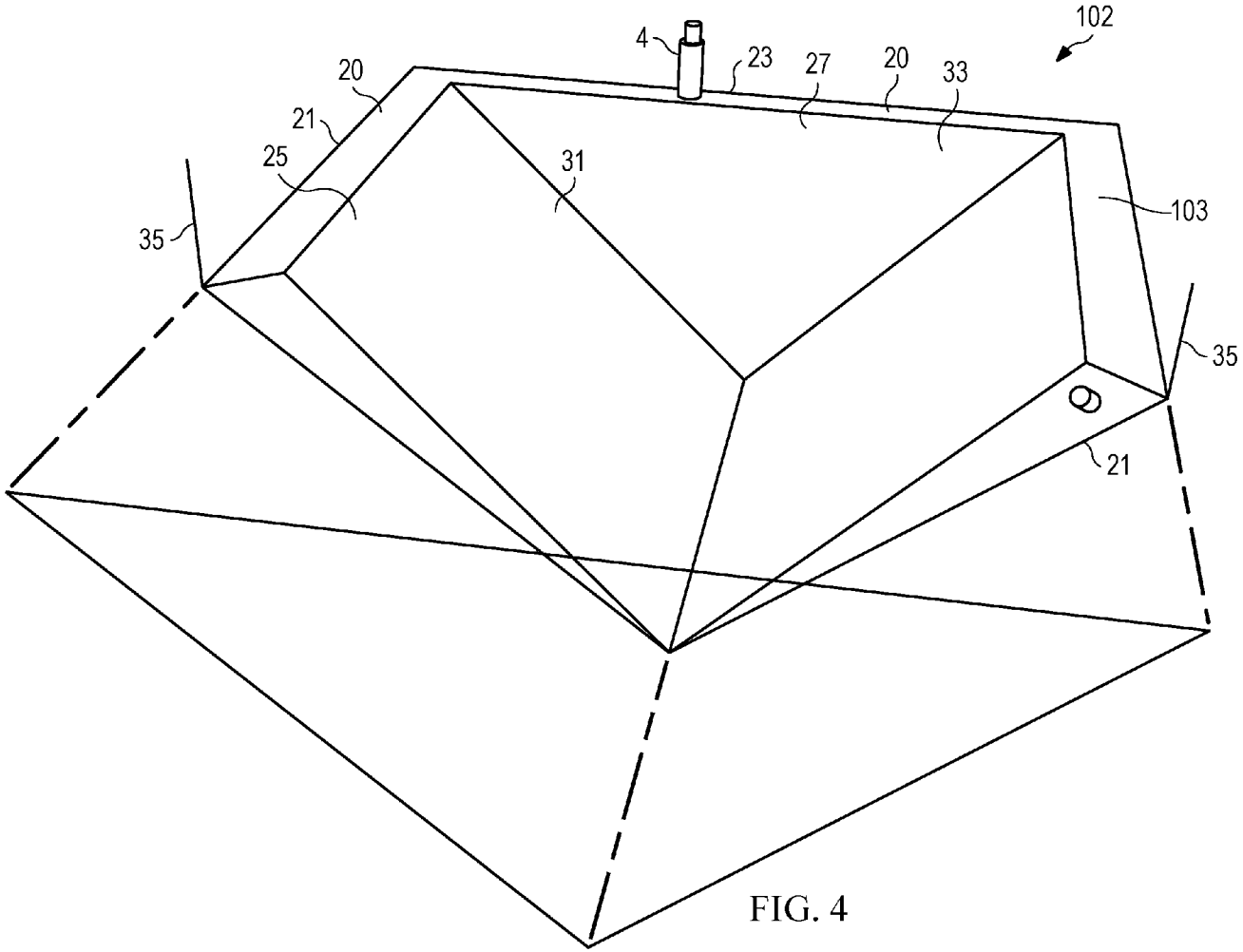
FIG. 4 illustrates a side perspective view of the exemplary trash container of the present invention.

FIG. 4 illustrates an exemplary trash container 102 having the top peripheral wall 20, the first outer mirror sidewalls 21, the second outer mirror sidewalls 23, the first inner mirror sidewalls 25, and the second inner mirror sidewalls 27 (all flexible, e.g., flexible frame 103) only extending around two sides of the trash container 102 to provide enhanced access to the holding cavity 31.

Figure 5:
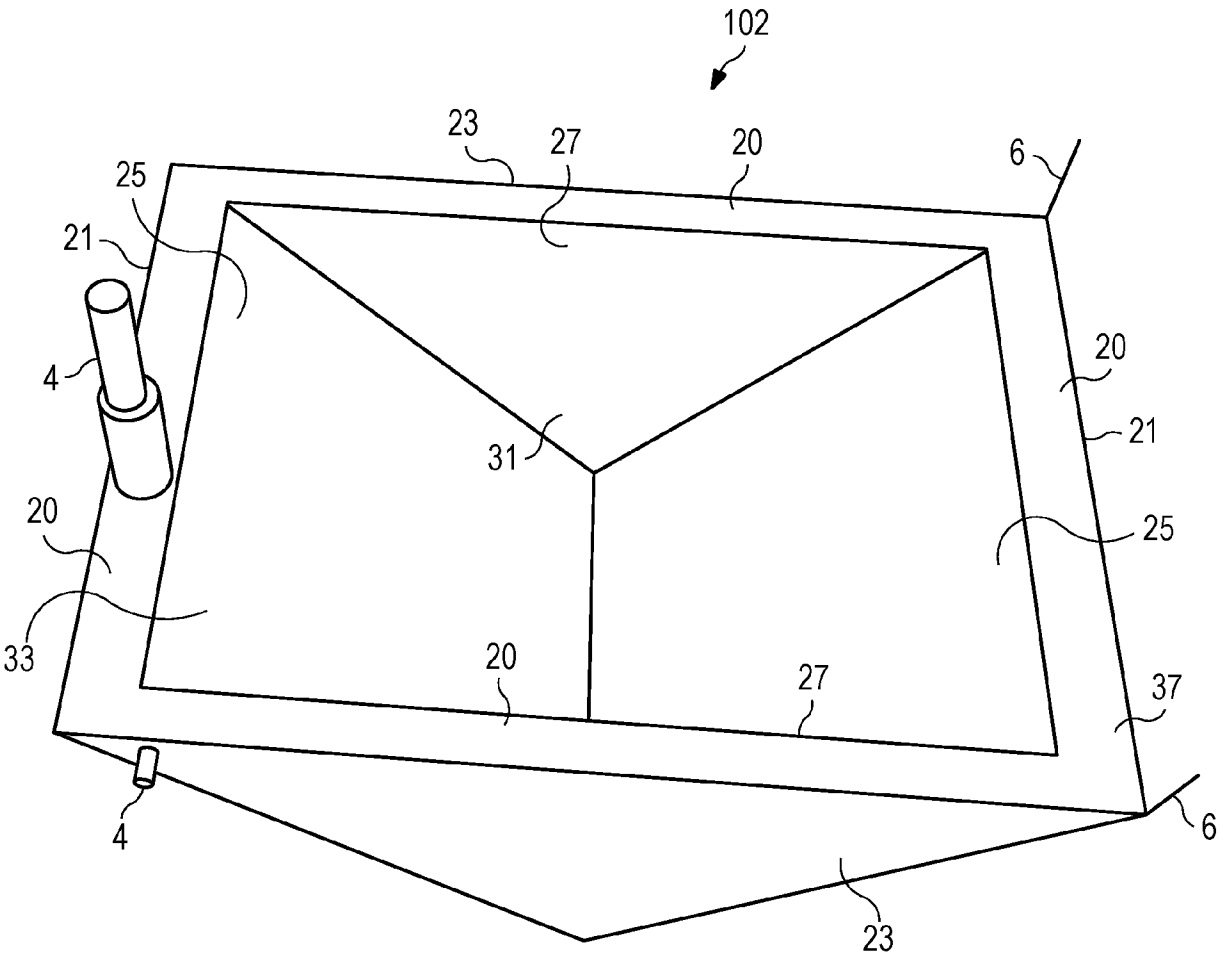
FIG. 5 illustrates a front perspective view of the exemplary trash container of the present invention.

FIG. 5 illustrates another exemplary trash container 102 of the present invention. The trash container may include a pair of opposing first outer mirror sidewalls 21 that may be flexible and may be substantially rectangular in shape and which may further be connected to a pair of opposing second outer mirror sidewalls 23 that may be flexible and may be connected around a continuous periphery of the first outer mirror sidewalls 21. The second outer mirror sidewalls 23 may be flexible and may be substantially triangular in shape.

The trash container 102 may include a pair of opposing first inner mirror sidewalls 25. The first inner mirror sidewalls 25 may be flexible and may be substantially rectangular in shape. The first inner mirror sidewalls 25 may further be in a spaced relationship with the first outer mirror sidewalls 21 defining a cavity 37 between the first inner mirror sidewalls 25 and the first outer mirror sidewalls 21. The first inner mirror sidewalls 25 may be flexible and may be connected to a pair of opposing second inner mirror sidewalls 27 in a spaced relationship with the second outer mirror sidewalls 23, defining a cavity 37 between the second inner mirror sidewalls 27 and the second outer mirror sidewalls 23. The first inner mirror sidewalls 25 and the second inner mirror sidewalls 27 may be connected around a noncontinuous periphery of the first inner mirror sidewalls 25 and the second inner mirror sidewalls 27.

FIG. 5 additionally illustrates an inflation tube 4 to inflate the trash container 102. The cavity 37 may be filled with fluid including a gas or liquid, such as air or water. The trash container 102 additionally includes a top peripheral wall 20 that may be flexible and may extend around and seal the first outer mirror sidewalls 21, the second outer mirror sidewalls 23, the first inner mirror sidewalls 25, and the second inner mirror sidewalls 27. The first and second inner mirror sidewalls 25, 27 define a holding cavity 31 where trash may be stowed. The holding cavity 31 may include an opening 33 to allow the trash to enter the holding cavity 31. The top peripheral wall 20 may have one or more tie straps 6.

Figure 3A:
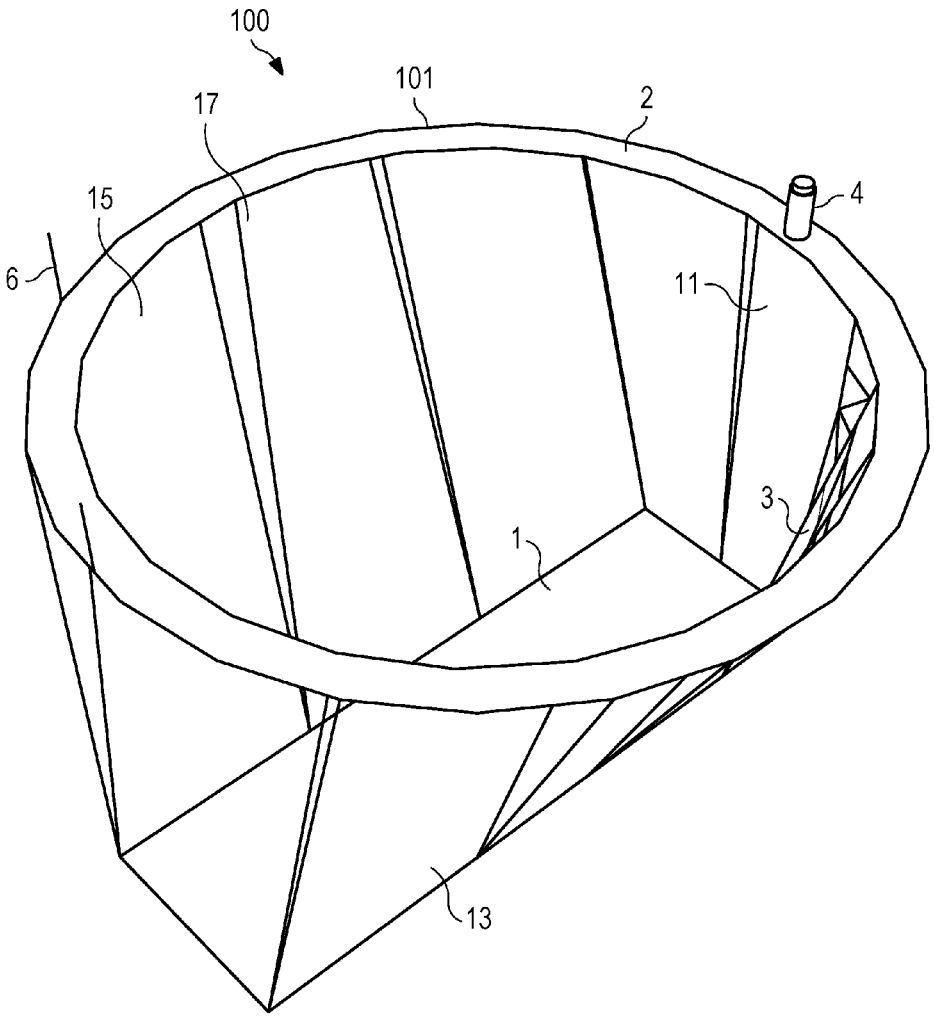
FIG. 3A illustrates a top perspective view of the exemplary trash container of the present invention.

FIG. 3A illustrates a perspective view of the trash container 100 of the present invention. The trash container 100 may include a bottom wall 1, which may be connected to an inner sidewall 11 and may further be connected to an outer sidewall 13. The inner sidewall 11 and the outer sidewall 13 may completely extend around the periphery of the bottom wall 1. The inner wall 11 and the outer wall 13 may be positioned in a spaced relationship to define a cavity 3, which may be filled with fluid, which may be a liquid, such as water, or a gas, such as air, in order to maintain the spaced relationship between the inner wall 11 and the outer wall 13 and such that the inner wall 11 and the outer wall 13 extend upwards from the bottom wall 1. The bottom wall 1 may be shaped as a rectangle, oval, square, circle or any other appropriate shape.

The inner sidewall 11 and the outer sidewall 13 may connect and may completely extend to and around a top peripheral wall. The top peripheral wall may be a top peripheral ring 2 that may form a seal with the inner sidewall 11 and the outer sidewall 13. Furthermore, the bottom wall 1 may form a seal with the inner sidewall 11 and the outer sidewall 13. The peripheral ring 2 may be a circle, oval, or any other appropriate shape. The peripheral ring 2 may define an opening 15 into a holding cavity 17 for users to place trash and be held until pick up. The peripheral ring 2 may have one or more tie straps 6.

FIG. 3A additionally illustrates an inflation tube 4 to inflate the cavity 3 and may include a valve or may include a sealing cap to seal the inflation tube 4. The material of the bottom wall 1, the top ring 2, the inner sidewall 11, and the outer sidewall 13 may be formed from flexible or rigid material or may be formed from thin plastic sheets such as HEFTY, GLAD, or a similar type of material to form flexible frame 101. The bottom wall 1 may be rigid and may be solid.

Figure 2A:
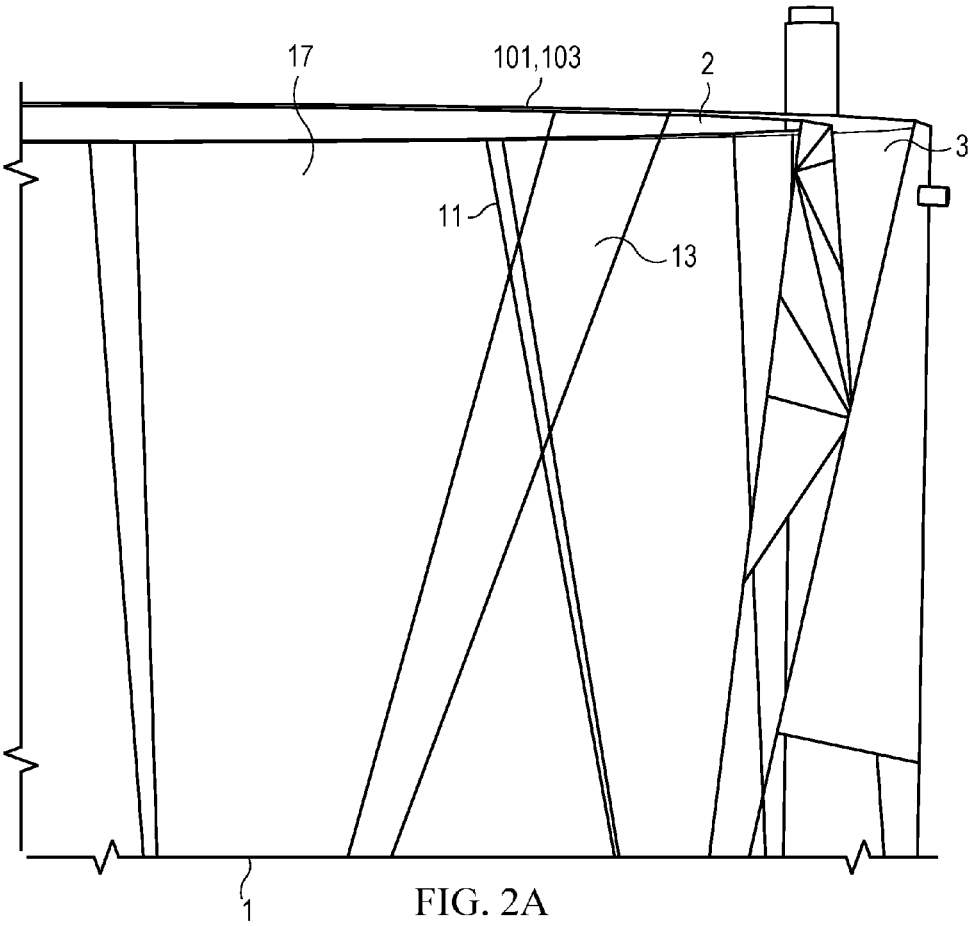
FIG. 2A illustrates a partial view of the exemplary trash container of the present invention.

FIG. 2A illustrates the cavity 3, defined by the bottom wall 1, the inner sidewall 11, and the outer sidewall 13.

Referring to FIGS. 2, 3, 4, and 5 collectively, an inflatable trash container 102 is illustrated. In various embodiments, the infiatable container 102 comprises four inner sidewalls 11. The four inner sidewalls 11 may comprise a first two of the inner sidewalls 25 that are rectangular and joined together at a bottom apex to form a lower portion of the inflatable container 102, the first two of the inner sidewalls 25 angling upwardly away from one another. The four inner sidewalls 11 may comprise a second two of the inner sidewalls 27 that are triangular and abut the first two of the inner sidewalls 25 at their edges to form a holding cavity 31 of the inflatable container 102.

In some embodiments, the inflatable container 102 comprises four outer sidewalls 13 placed in spaced apart relationship to the four inner sidewalls 11 to form a fluid cavity 37. For example, a top peripheral wall 20 creating a seal between top edges of the four inner sidewalls 11 and top edges of the four outer sidewalls 13 may be present. In other examples, an inflation tube 4 can be coupled to the top peripheral wall 20 for introducing a fluid into the fluid cavity 37. Further, the inflatable container 102 may include a tie strap 6 extending from the top peripheral wall 20. According to other embodiments, the inflatable container 102 may have a fluid discharge valve coupled with any one of the four outer sidewalls 13.

In further embodiments, the four inner sidewalls 11 of the inflatable container 102 can comprise a first two of the inner sidewalls 25 that are rectangular and joined together at a bottom apex to form a lower portion of the inflatable container 102, the first two of the inner sidewalls 25 angling upwardly away from one another. The four inner sidewalls 11 may further comprise a second two of the inner sidewalls 27 that are triangular and abut the first two of the inner sidewalls 25 at their edges to form a holding cavity 31 of the inflatable container 102, according to some embodiments.

In other embodiments, the inflatable container 102 can comprise four outer sidewalls 13. The outer sidewalls 13 may comprise a first two of the outer sidewalls 21 that are rectangular and joined together at a bottom apex to form a lower portion of the inflatable container 102, the first two of the outer sidewalls 21 angling upwardly away from one another. The four outer sidewalls may further comprise a second two of the outer sidewalls 23 that are triangular and abut the first two of the outer sidewalls 21 and the first two of the inner sidewalls 23 at their edges to form a holding cavity 31 of the inflatable container 102.

In some embodiments, pairs of the first two of the inner sidewalls 25 and the first two of the outer sidewalls 21 are spaced apart from one another at an angle to form wedges. For example, a top peripheral wall 20 creating a seal between top edges of the four inner sidewalls 11 and top edges of the four outer sidewalls 13 may be present. Further, the inflatable container 102 may include an inflation tube 4 that can be coupled to the top peripheral wall 20 for introducing a fluid into a fluid cavity 37.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. An inflatable container, comprising:

four inner sidewalls, comprising:

wherein a first two of the inner sidewalls are rectangular and joined together at a bottom apex to form a lower portion of the inflatable container, the first two of the inner sidewalls angling upwardly away from one another; and wherein a second two of the inner sidewalls are triangular and abut the first two of the inner sidewalls at their edges to form a holding cavity of the inflatable container;

four outer sidewalls placed in spaced apart relationship to the four inner sidewalls to form a fluid cavity;

a top peripheral wall creating a seal between top edges of the four inner sidewalls and top edges of the four outer sidewalls; and an inflation tube coupled to the top peripheral wall for introducing a fluid into the fluid cavity.

2. The inflatable container according to claim 1, further comprising a tie strap extending from the top peripheral wall.

3. The inflatable container according to claim 1, further comprising a fluid discharge valve coupled with any one of the four outer sidewalls.

4. An inflatable container, comprising:

four inner sidewalls, comprising:

wherein a first two of the inner sidewalls are rectangular and joined together at a bottom apex to form a lower portion of the inflatable container, the first two of the inner sidewalls angling upwardly away from one another; and wherein a second two of the inner sidewalls are triangular and abut the first two of the inner sidewalls at their edges to form a holding cavity of the inflatable container;

four outer sidewalls, comprising:

wherein a first two of the outer sidewalls are rectangular and joined together at a bottom apex to form a lower portion of the inflatable container, the first two of the outer sidewalls angling upwardly away from one another;

wherein a second two of the outer sidewalls are triangular and abut the first two of the outer sidewalls and the first two of the inner sidewalls at their edges to form a holding cavity of the inflatable container; and wherein pairs of the first two of the inner sidewalls and the first two of the outer sidewalls are spaced apart from one another at an angle to form wedges;

a top peripheral wall creating a seal between top edges of the four inner sidewalls and top edges of the four outer sidewalls; and an inflation tube coupled to the top peripheral wall for introducing a fluid into a fluid cavity.

* * * * *